US007251907B1

(12) United States Patent
Bondarchuk

(10) Patent No.: US 7,251,907 B1
(45) Date of Patent: Aug. 7, 2007

(54) AIR VENTILATED SHOES

(76) Inventor: Leonid P Bondarchuk, 2222 NE. 293rd Ave., Fairview, OR (US) 97024

( * ) Notice: Subject to any disclaimer, the term of this patent is extended or adjusted under 35 U.S.C. 154(b) by 43 days.

(21) Appl. No.: 11/151,241

(22) Filed: Jun. 13, 2005

(51) Int. Cl.
*A43B 7/06* (2006.01)

(52) U.S. Cl. ..... 36/3 B

(58) Field of Classification Search ..... 36/3 B, 36/3 R

See application file for complete search history.

(56) References Cited

U.S. PATENT DOCUMENTS 4,078,321 A * 3/1978 Famolare, Jr. ..... 36/3 B
4,776,110 A * 10/1988 Shiang ..... 36/3 B
5,400,526 A * 3/1995 Sessa ..... 36/3 B
6,041,519 A * 3/2000 Cheng ..... 36/3 R
2005/0223594 A1* 10/2005 Issler ..... 36/3 B

* cited by examiner

*Primary Examiner*—Ted Kavanaugh
(74) *Attorney, Agent, or Firm*—Michael I Kroll

(57) ABSTRACT

Apparatus 10 discloses a shoe 12 incorporating a ventilation system comprised of a port 14 positioned within the wall of the shoe, which in the preferred embodiment is located approximate the in-step 20. In communication with the port 14 is a cavity situated within the arch 29 whereby as a force applied to the base of the shoe causes the cavity to expand and contract drawing air from the shoe's exterior. Extending from the arch cavity 29 are a plurality of conduits 22 spatially around and across the base of the shoe 12 terminating in a plurality of apertures 24 extending from the conduits into the interior of the shoe. In addition, a plurality of nodules 30 are formed on the top side of the sole 26 to provide comfort to the user and to space the foot away from the sole, which will aid in the circulation of the air.

4 Claims, 8 Drawing Sheets

AIR VENTILATED SHOES

BACKGROUND OF THE INVENTION

1. Field of the Invention

The present invention relates generally to shoes and, more specifically, to a shoes incorporating a ventilation system whereby ambient air is moved from the exterior of the shoe to the interior of the shoe proving climate control within said shoes with the intake port optionally providing a replaceable filter element.

The ventilation system is comprised of a port positioned within the wall of the shoe, which in the preferred embodiment is located approximate the in-step. In communication with the port is a cavity situated within the arch whereby as a force is applied to the base of the shoe caused the cavity to expand and contract drawing air from the shoe's exterior. Extending from the arch cavity are a plurality of conduit spatially around across the base of the shoe termination in a plurality of apertures extending from the conduits into the interior of the shoe. In addition, a plurality of nodules are formed on the top side of the sole to provide comfort to the user and to space the foot away from the sole, which will aid in the circulation of the air.

2. Description of the Prior Art

There are other shoes having vents for moving air from the interior to the exterior and vis versa While these shoes may be suitable for the purposes for which they were designed, they would not be as suitable for the purposes of the present invention, as hereinafter described.

Therefore, it is felt that a need exists whereby ambient air is moved to the interior of the shoe to reduce the temperature and moisture accumulation and thereby giving the user comfort and significant climate control inside of the shoe during physical exercises such as, hiking, playing, running and various other sport activities.

SUMMARY OF THE PRESENT INVENTION

The present invention discloses a shoe incorporating a ventilation system comprised of a port positioned within the wall of the shoe, which in the preferred embodiment is located approximate the in-step. In communication with the port is a cavity situated within the arch whereby as a force applied to the base of the shoe causes the cavity to expand and contract drawing air from the shoe's exterior. Extending from the arch cavity are a plurality of conduits spatially around and across the base of the shoe terminating in a plurality of apertures extending from the conduits into the interior of the shoe. In addition, a plurality of nodules are formed on the top side of the sole to provide comfort to the user and to space the foot away from the sole, which will aid in the circulation of the air.

A primary object of the present invention is to provide a shoe incorporating a ventilation system that works off of activity by the user.

Another object of the present invention is to provide a ventilated shoe having a port with a filter proving a source of ambient air.

Yet another object of the present invention is to provide a ventilated shoe wherein said filter is a screen.

Still yet another object of the present invention is to provide a ventilated shoe having a pump positioned within the shoe.

Another object of the present invention is to provide a ventilated shoe wherein said pump is located in the arch of the shoe in communication with the vent port.

Yet another object of the present invention is to provide a ventilated shoe having a plurality of conduits throughout the sole of the shoe.

Still yet another object of the present invention is to provide a ventilated shoe wherein said conduits are in communication with the pump cavity.

Another object of the present invention is to provide a ventilated shoe having a plurality of apertures extending from said conduits to the interior of the shoe.

Yet another object of the present invention is to provide a ventilated shoe having a plurality of nodules protruding from the top of the sole.

Still yet another object of the present invention is to provide a ventilated shoe wherein the nodules and ventilation aperture are spaced apart aiding in the circulation of the ventilation system.

Additional objects of the present invention will appear as the description proceeds.

The present invention overcomes the shortcomings of the prior art by providing a ventilation system for shoes comprised of a port positioned within the wall of the shoe in communication with a cavity situated within the arch whereby as a force is applied to the base of the shoe causes the cavity to expand and contract drawing air from the shoe's exterior. Extending from the arch cavity are a plurality of conduit spatially around across the base of the shoe termination in a plurality of apertures extending from the conduits into the interior of the shoe. In addition, a plurality of nodules are formed on the top side of the sole to provide comfort to the user and to space the foot away from the sole, which will aid in the circulation of the air.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
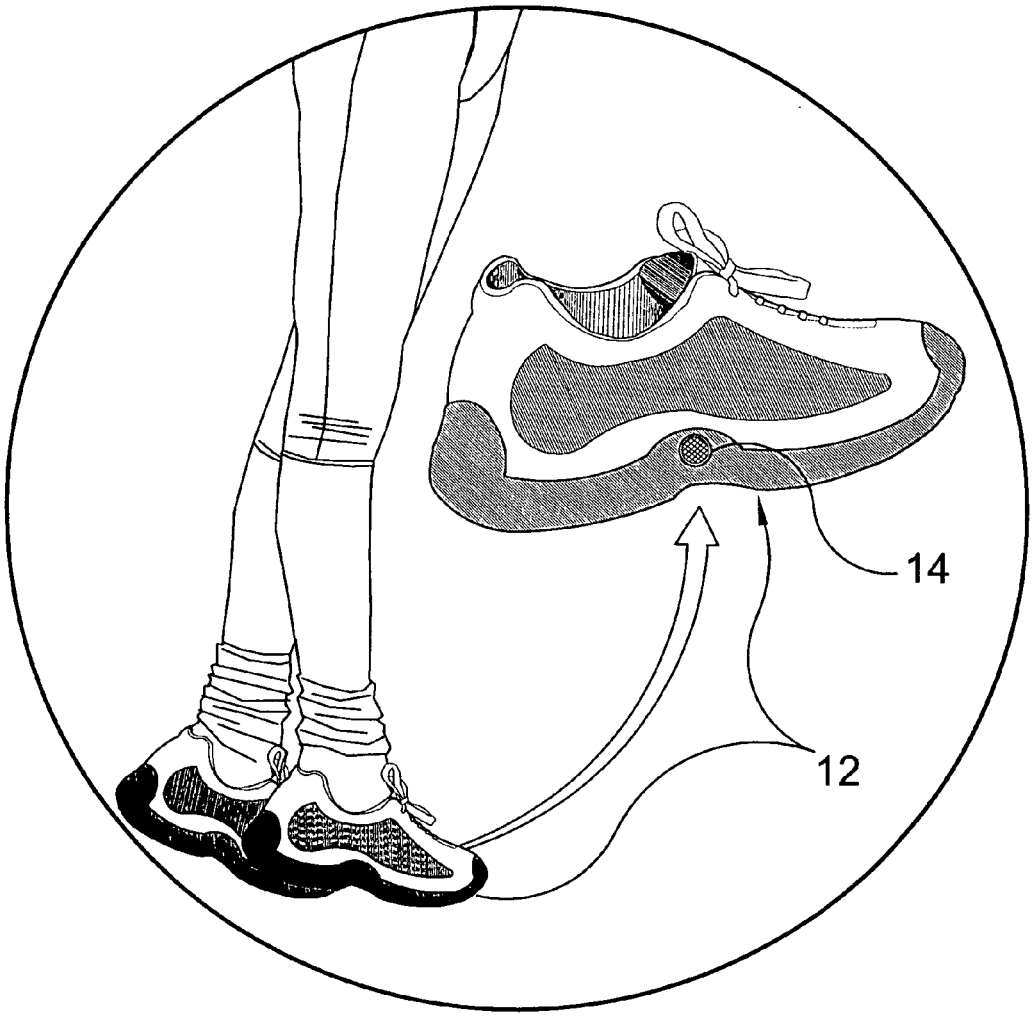
FIG. 1 is an illustrative view of the present invention in use.

With regard to reference numerals used, the following numbering is used throughout the drawings.

10 present invention
12 shoe
14 air intake port
16 pump
18 screen
20 arch
22 channels
24 ports
26 sole
28 air flow arrows
29 cavity
30 sole bumps
32 in-sole

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments since practitioners skilled in the art will recognize numerous other embodiments as well. For a definition of the complete scope of the invention the reader is directed to the appended claims.

Turning to FIG. 1, shown therein is an illustrative view of the present invention in use. Shown is an illustrated view of the ventilated sports shoe 12 of the present invention comprising an air ventilated shoe having an air intake port 14 and screen that allows air to circulate through ventilation ports when pressure is applied to the lateral arch pump within the sole of the sport shoe. The design provides the wearer with comfort and significant climate control inside the sport shoe 12, allowing the wearer to gain more performance in its practical use.

Figure 2:
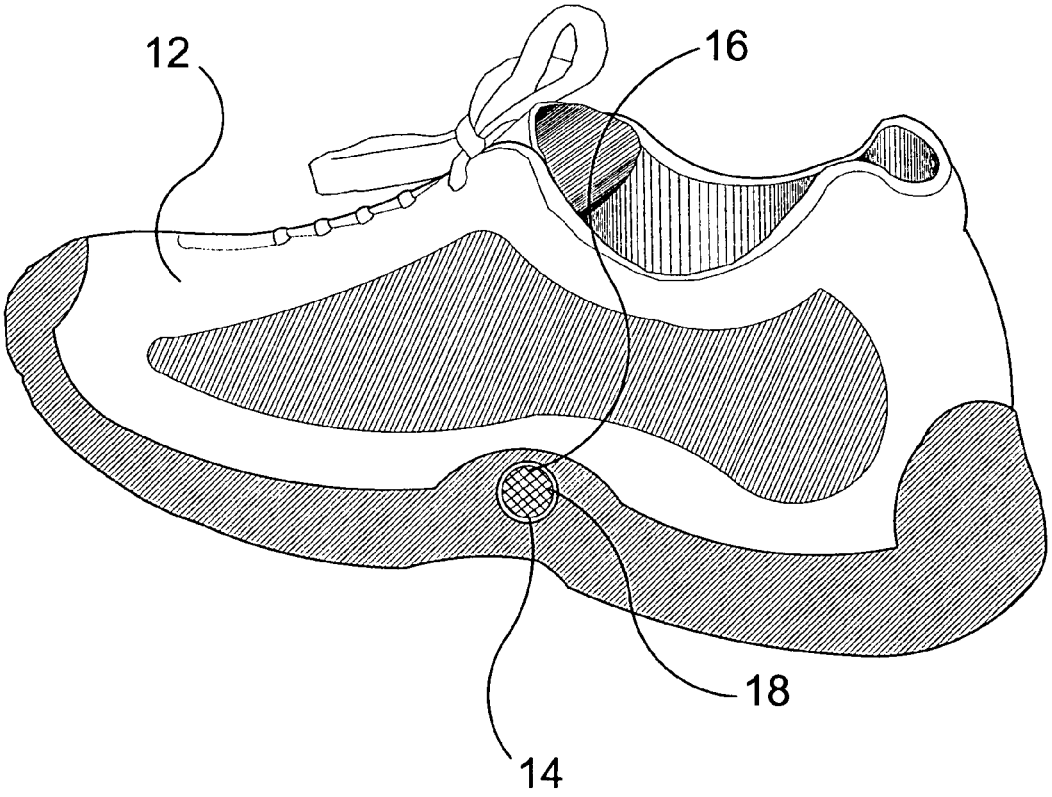
FIG. 2 is a perspective view of the present invention.

Turning to FIG. 2, shown therein is a perspective view of the present invention. Shown is the ventilated sports shoe 12 of the present invention with an air intake port 14 positioned within the wall of the shoe whereby ambient air is taken and distributed through conduits by means of a pump 16. Additionally, the intake port can incorporate a replaceable screen or filter element 18.

Figure 3:
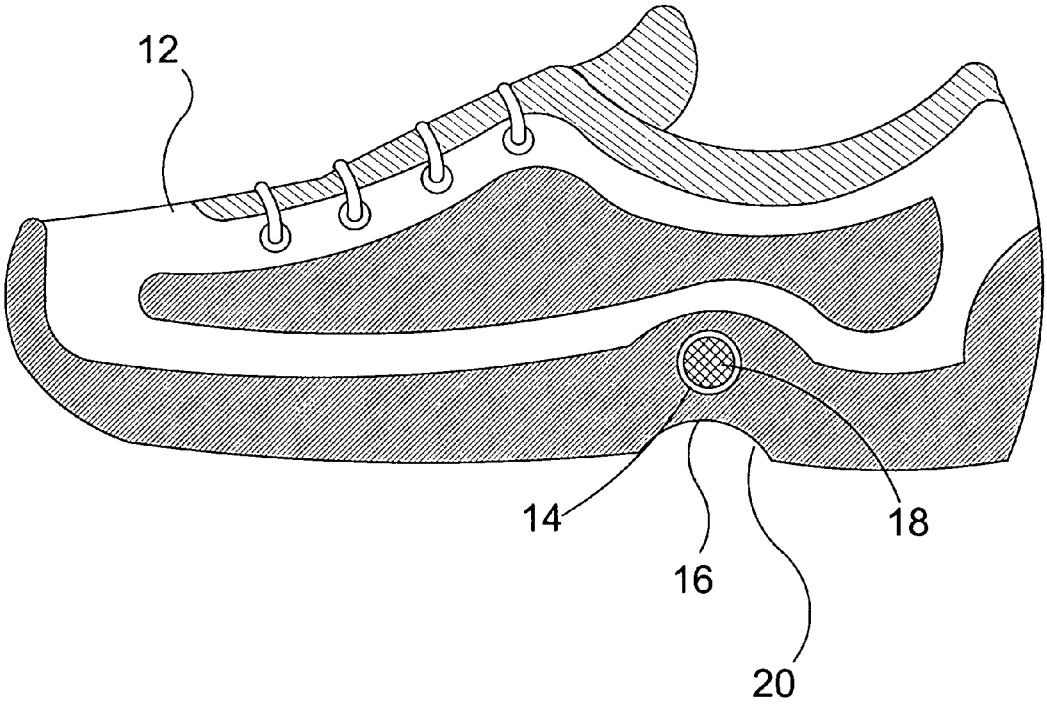
FIG. 3 is an instep view of the present invention.

Turning to FIG. 3, shown therein is an instep view of the present invention. Shown is the ventilated sports shoe 12 of the present invention with an air intake port 14 with screen 18 positioned within the wall of the shoe whereby ambient air is taken and distributed through conduit by means of a pump 16 positioned within the shoe arch 20.

Figure 4:
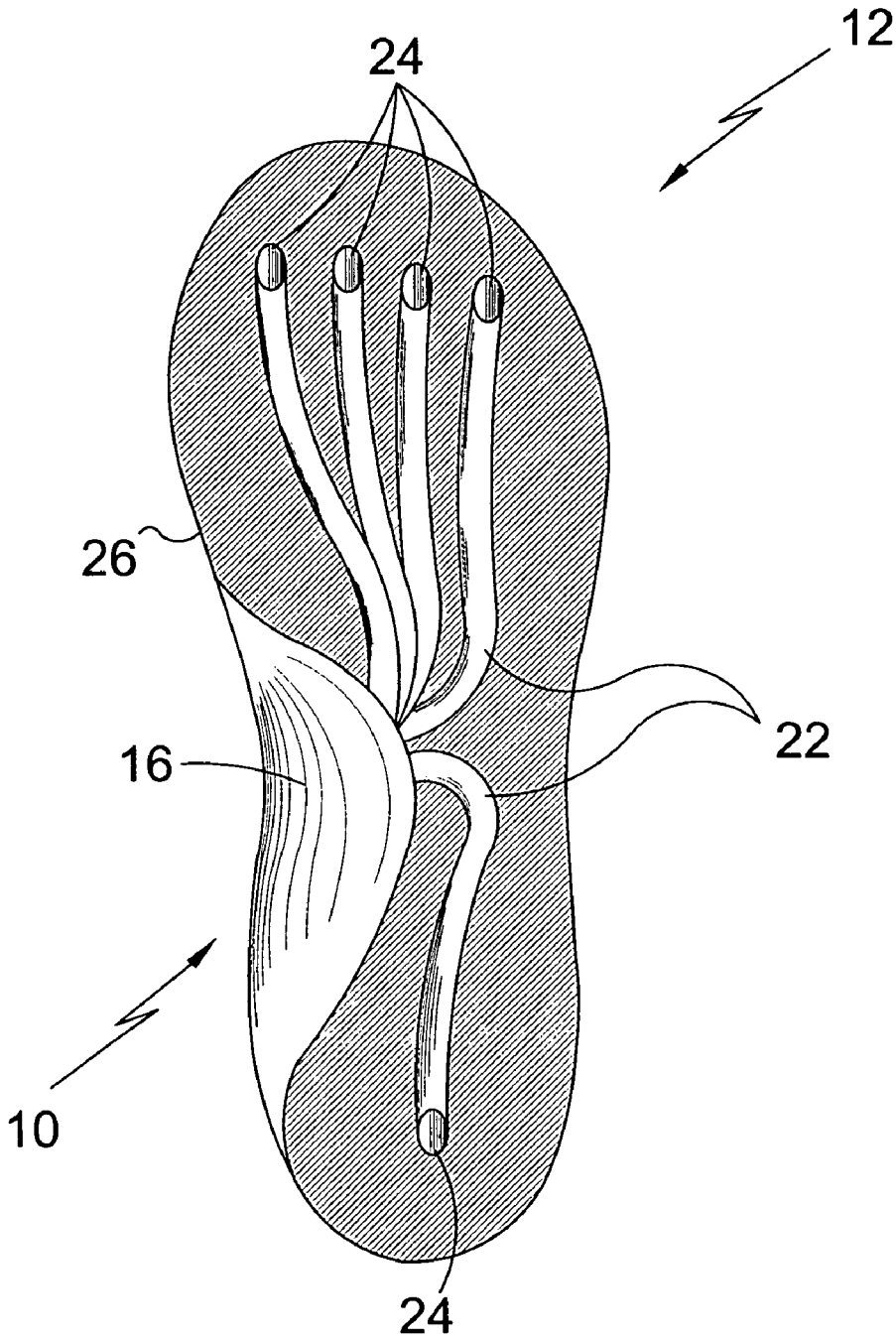
FIG. 4 is a sectional top view of the present invention.

Turning to FIG. 4, shown therein is a sectional top view of the present invention 10. Depicted are a plurality of channels 22 providing egress ports 24 throughout the shoe 12 for the ambient air drawn into the shoe by means of an arch positioned pump 16. In operation, a user compresses and expands the pump cavity during any motion that applies a force to the shoe in cyclical fashion. Also shown is the sole 26 of the shoe 12.

Figure 5:
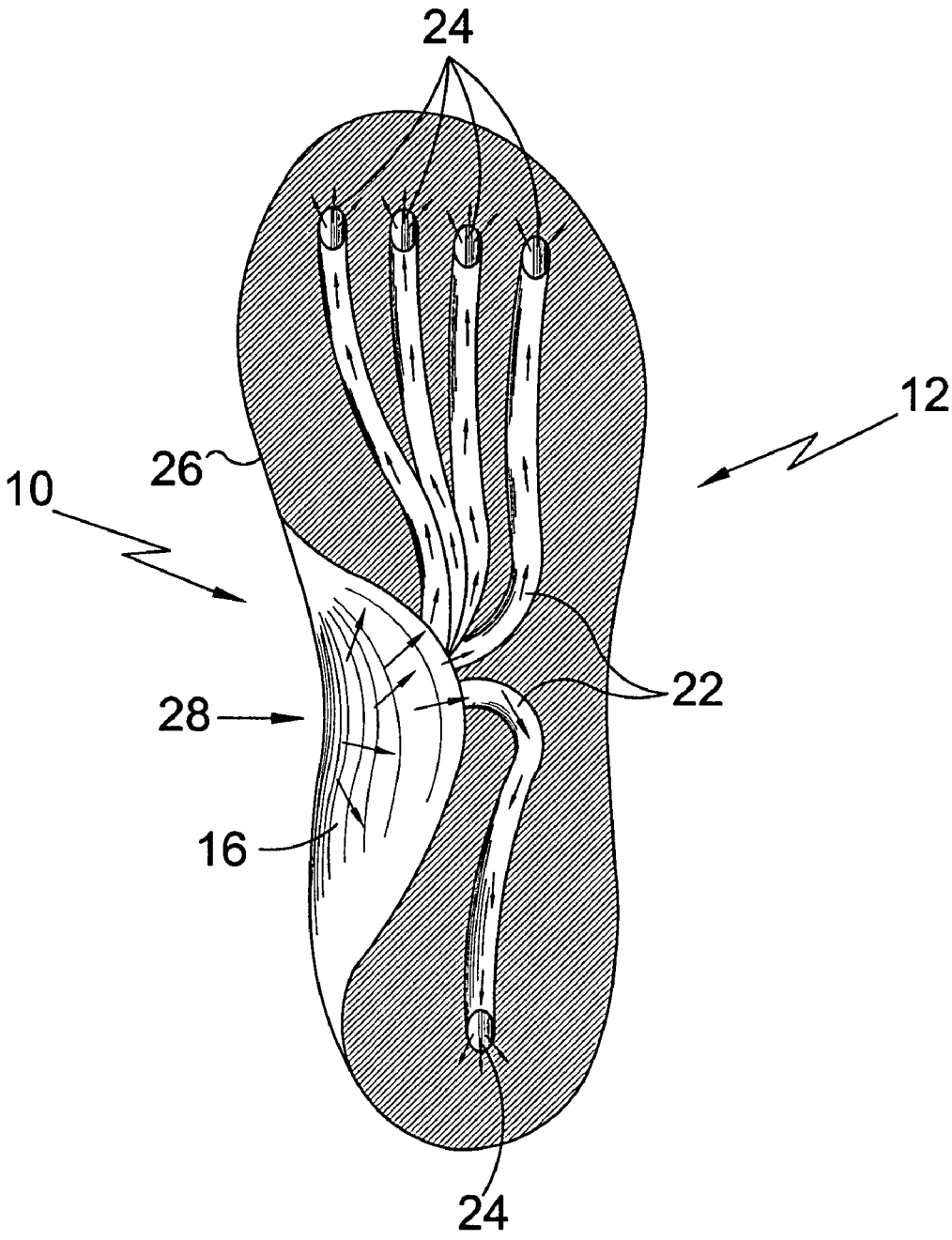
FIG. 5 is a sectional view of the ventilation system of the present invention.

Turning to FIG. 5, shown therein is a sectional view of the ventilation system of the present invention 10. Illustrated is the ventilation system that is incorporated into a sole 26 of a shoe 12 by means of a port positioned within the instep wall of the shoe in communication with a pump 16 that draws in ambient air and distributes the air shown by arrows 28 throughout the shoe through multiple conduits 22 with ports 24.

Figure 6:
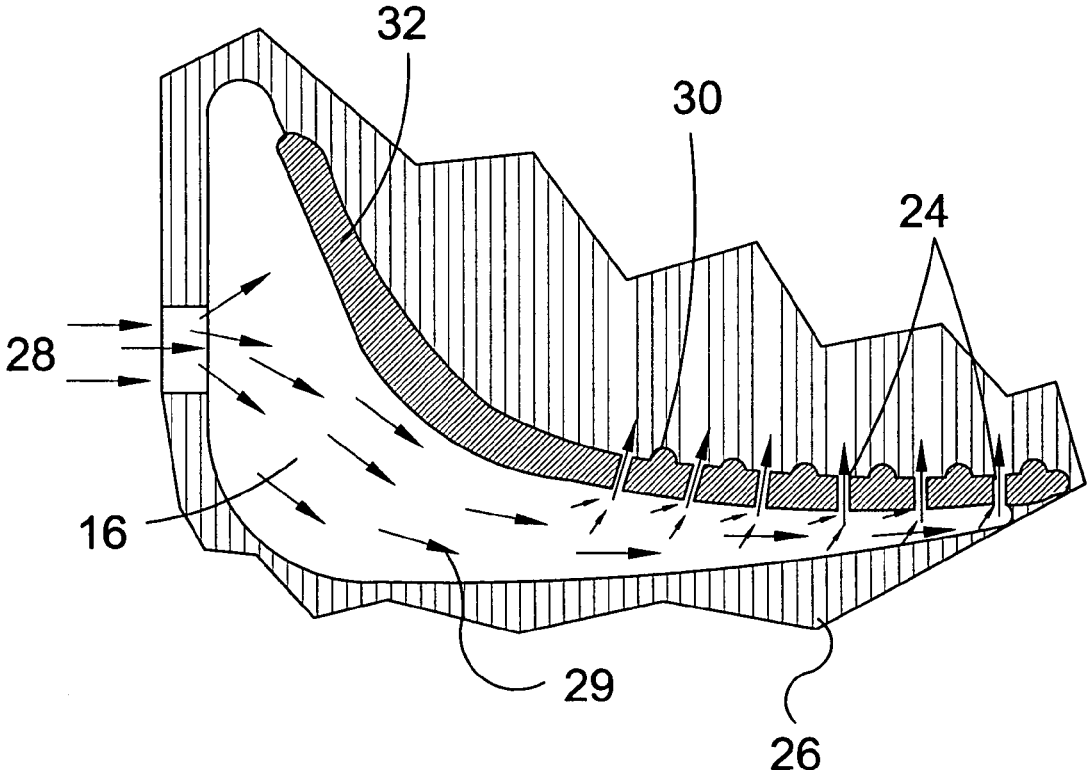
FIG. 6 is an enlarged view of the pump of the present invention.

Turning to FIG. 6, shown therein is an enlarged view of the pump 16 of the present invention. Illustrated is the pump means 16 of the present invention positioned within the in-step area or arch whereby normal use causes the pump cavity 29 to expand and contract drawing in ambient air and moving it at 28 through conduits positioned adjacent or within the in-sole 32 to predetermined egress apertures or ports 24 on the inside of the shoe. Also shown are the sole 26 and sole bumps 30.

Figure 7:
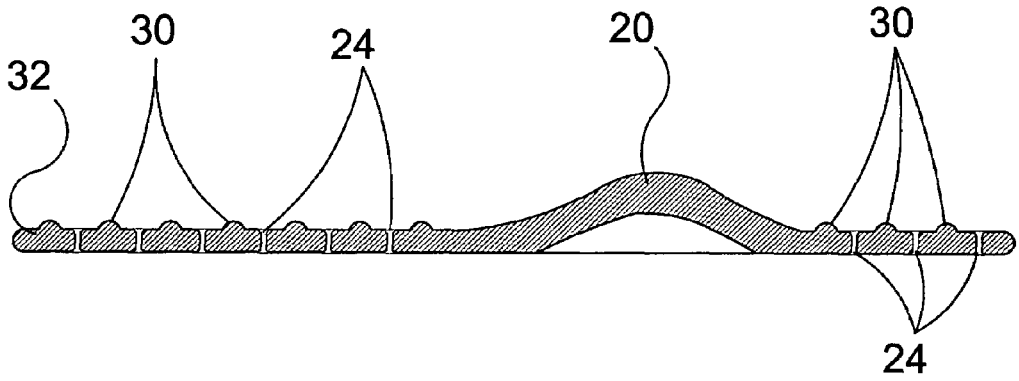
FIG. 7 is a side sectional view of the sole of the present invention.

Turning to FIG. 7, shown therein is a side sectional view of the sole of the present invention. Depicted is a sectional view of the sole forming the pump over the arch 20 and a plurality of apertures 24 passing therethrough acting as ventilation ports. Also shown, are in-sole 32 and a plurality of sole bumps 30 that help space the foot away from the ventilation ports 24 aiding in air circulation.

Figure 8:
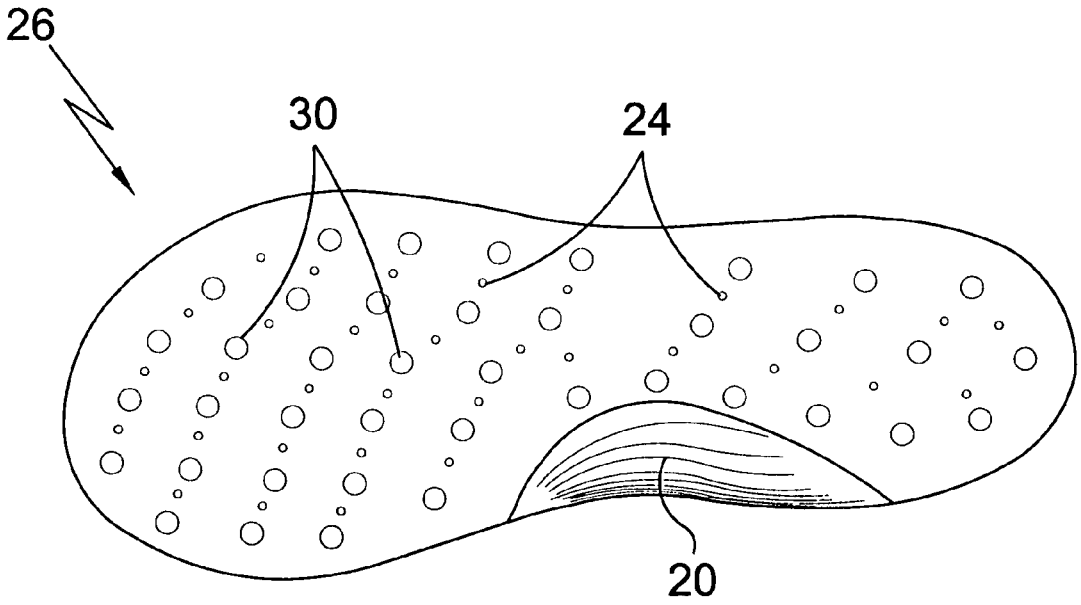
FIG. 8 is a top view of the sole of the present invention.

Turning to FIG. 8, shown therein is a spaced apart top view of the sole of the present invention. Shown is the sole 26 of the shoe 12 having multiple ventilation ports 24 and spaced away nodules or bumps 30 that provide maximum comfort to the feet and help in circulating air throughout the interior of the shoe. Also shown is arch 20 which contains the pump.

I claim:

1. An apparatus for ventilating shoes, the shoe having a sole, a wall, an in-step area and an in-sole, comprising:

a) pump means consisting of a cavity disposed in an arch area of the sole of the shoe whereby ambient air is drawn in from outside the shoe and distributed to the interior of the shoe actuated by the alternating expansion and contraction caused by a user walking in the shoe;

b) a single intake port being disposed in the wall of the shoe for supplying outside air to said pump means, said intake being located above an upper surface of said sole;

c) a plurality of conduits being disposed in the sole of the shoe for distributing air to the interior of the shoe, each said conduit having first and second ends, wherein said first end of each conduit is connected to said pump means and said second end of each conduit is spaced apart throughout the interior of the shoe;

d) a plurality of egress ports being disposed on said second end of each said conduit only along said upper surface of said sole, said intake port being substantially greater in size than said egress ports; and, e) a plurality of sole bumps being disposed on the interior of the in-sole of the shoe to permit a foot of a user to be spaced away from the egress ports.

2. The apparatus of claim 1, further comprising a filter being disposed in said intake port to permit the outside air to be filtered before distribution to the interior of the shoe.

3. The apparatus of claim 2, wherein said intake port is disposed in the in-step area of the shoe.

4. The apparatus of claim 2, wherein said egress ports are located along said upper surface of said sole with some egress ports in a heel area of said sole.

* * * * *